United States Patent [19]

Keran et al.

[11] 4,330,325

[45] May 18, 1982

[54] DIRECT REDUCTION ROTARY KILN WITH IMPROVED AIR INJECTION

[75] Inventors: Vitie P. Keran; Alan C. Baker, both of Harriman, Tenn.

[73] Assignee: The Direct Reduction Corporation, New York, N.Y.

[21] Appl. No.: 224,151

[22] Filed: Jan. 12, 1981

Related U.S. Application Data

[62] Division of Ser. No. 51,017, Jun. 22, 1979, Pat. No. 4,273,314.

[51] Int. Cl.[3] ..... C21B 13/08

[52] U.S. Cl. ..... 75/36

[58] Field of Search ..... 75/33, 36, 37, 38, 34, 75/35; 266/145, 213

[56] References Cited

U.S. PATENT DOCUMENTS 1,977,117 10/1934 Debuch ..... 75/36

3,890,138 6/1975 Hockin ..... 75/36

*Primary Examiner*—M. J. Andrews

*Attorney, Agent, or Firm*—Cooper, Dunham, Clark, Griffin & Moran

[57] ABSTRACT

In the direct reduction process for reducing iron ore to sponge iron of the type disclosed in U.S. Pat. No. 3,890,138 to Hockin wherein all of the air supply tubes along the rotary kiln inject air toward the discharge end of the kiln it has been found that by reversing the direction of injection of the air from one or more of the tubes in the preheat zone of the kiln the condition of the off-gases can be considerably improved without affecting the process in the reduction zone and ultimately the quality of the resulting product and improved preheating of the kiln charge can be effected without the formation of undesirable kiln accretions.

9 Claims, 2 Drawing Figures

DIRECT REDUCTION ROTARY KILN WITH IMPROVED AIR INJECTION

This is a division of application: Ser. No. 51,017, Filed June 22, 1979 now U.S. Pat. No. 4,273,314.

BACKGROUND OF THE INVENTION

The present invention relates to a direct reduction process for the reduction of iron ores in a rotary kiln provided with air injection pipes along its length and using countercurrent flow of gas and charge, and more particularly, to an improved method and means for introducing the air flow into the kiln.

Various methods have been suggested and used for carrying out the direct reduction process using high volatile coal as heating agent and reductant in a rotary kiln. For example, in some of these processes the coal is fed into the kiln through the discharge end by mechanical or pneumatic means, such as disclosed in U.S. Pat. No. 3,505,060 to Heitmann, and in some it is fed at the center of or along the kiln, such as disclosed in U.S. Pat. No. 3,206,299 to Senior et al. However, considerable disadvantages have arisen in blowing all of the high volatile coal into the kiln from the discharge end, and in feeding such coal at the center of the kiln. Because air is supplied to the kiln at a constant rate, unless altered by the intervention of the operator, and the composition of the chamber gas is subject to fluctuation, the reducing and combustion processes are not uniform, and the control of the process is adversely affected. When the reducing agent used has a high content of volatile matter or moisture, such as is the case with many low grade coals, the pressure in the rotary kiln is also subject to general and local fluctuations which further affect control of the process and which lead to a nonuniform discharge of solids from the kiln. As the distribution of the coal throughout the kiln is so highly critical, addition of all the coal from the discharge end makes the process difficult to control for simple mechanical and metallurgical reasons.

Further, although benefits are derived in regard to fixed carbon consumption when feeding all the fuel and reductant requirements in the form of a high volatile coal from the discharge end of the kiln, the control of the operation can be very difficult due to the large amount of fuel and reductant that has to be fed and the need to have highly precise distribution of the fuel if a high degree of reduction is to be achieved. It has been found in practice that it is not possible to maintain this fuel distribution, and consequently variable reduction results. It has also been found that the incorporation of high volatile coal into the kiln bed at the discharge end of the kiln results in impaired reduction capability in the kiln due to variations in the $CO/CO_2$ ratio in the bed and in the chamber gas, and that this situation tends to limit the degree of metallization to a level below that required for commercial practicality.

On the other hand, feeding of a high volatile coal from the feed end of a countercurrent flow system leads to a loss of volatile material in the first section or preheat zone of the kiln. These volatiles are removed by the combustion gas flow and are thus lost to the process and increase the heat value of the kiln off gas, and only a portion of the gases from the low temperature distillation of the coal can be used for the process. The increased heat value of the off gas can further cause operating difficulties in the off-gas exhaust or processing system.

The disadvantages of these various approaches have been overcome by feeding a portion of the coal from the discharge end of the kiln sufficient to control the temperature profile throughout the kiln and feeding the remaining portions of the coal at the feed end while ensuring that the coal from the discharge end is distributed in the kiln in such a manner that substantially no coal lands in the reducing zone within the last 15% of the kiln length and is distributed to within the feed end zone of the kiln. The rotary kiln is fitted along its length with air injection devices which blow air countercurrent to the general flow of reducing gases within the kiln to produce mixture therebetween. A system of this type is disclosed in U.S. Pat. No. 3,890,138 to Hockin, particularly for use in reducing ilmenite. However, while this latter technique improves upon the other coal feeding methods in the direct reduction process, when it is used for reducing iron ore to sponge iron, certain problems still remain in the content of the exhaust or off gases requiring special attention in the off-gas processing or cleaning system.

It has generally been the practice in the direct reduction art to direct the air supply within the kiln along its length toward the feed end in keeping with the early teachings of Moklebust, for example, in U.S. Pat. No. 2,829,042 and subsequently in U.S. Pat. No. 3,170,786, as well as the teaching in the previously cited U.S. Pat. No. 3,206,299 to Senior et al. However, Meyer et al in U.S. Pat. No. 3,235,375 teaches the directing of the air flow preferably toward the discharge end or in either or both directions to achieve improved heat distribution and more effective combustion of carbon monoxide gas while obviating localized overheating of the charge mixture and formation of wall accretions.

The practice in the process of Hockin, U.S. Pat. No. 3,890,138, when reducing iron ore to sponge iron has been to direct the air toward the discharge end of the kiln countercurrent to the reducing gas flow to enhance mixing. Such is the arrangement shown in the prior art diagram of FIG. 1 which illustrates the components of a direct reduction plant for producing sponge iron in accordance with the HOCKIN process. Although the HOCKIN process overcomes many of the problems of the prior art, still as noted above, difficulties have been encountered in handling the off-gases. The present invention involves certain improvements which have been discovered in the operation of the illustrated plant for the HOCKIN process.

SUMMARY OF THE INVENTION

In accordance with the present invention, it has been found that in a direct reduction process of the HOCKIN type when the introduction of air into the kiln is directed oppositely in the preheat zone from the reducing zone, that is, toward the feed end rather than the discharge end, substantially complete reaction of the air with the combustible components in the preheat zone is achieved, and thus the composition of the off-gas is considerably improved, and improved preheating of the kiln charge can be effected without the formation of undesirable kiln accretions. More particularly, rather than blowing all of the air countercurrent to the combustion gases as in the past, with the present invention, while the air injection tubes in the reducing or working zone are directed to blow the air toward the discharge end of the kiln, one or more of the air injection tubes in the preheat zone are oriented to blow the air toward the feed end. The improved condition of the waste or off-gas resulting from this improved air blowing arrangement obviates the need for using an afterburner in the off-gas system, as has been used in some of the other direct reduction kilns wherein all of the air has been directed toward the feed end of the kiln. The approach of the present invention differs from that of Meyer et al in previously-noted U.S. Pat. No. 3,235,375 which, while suggesting the opposite directing of the introduced air flow, does not limit the opposite directing of the air flow to and within either of the different zones of the kiln. Unlike Meyer et al, no supplementary fuel is used in the process of the present invention, and by virtue of reversing the tubes only in the feed end or preheating zone, relatively large quantities of air are introduced to combust volatiles without affecting the desired temperature profile of the charge material in the entire length of the kiln and without causing sticking of gangue material on the pellets and/or sticking of particles of the charge on the wall of the kiln, such as may occur in the Meyer et al process.

DETAILED DESCRIPTION OF THE PREFERRED EMBODIMENT

Figure 1:
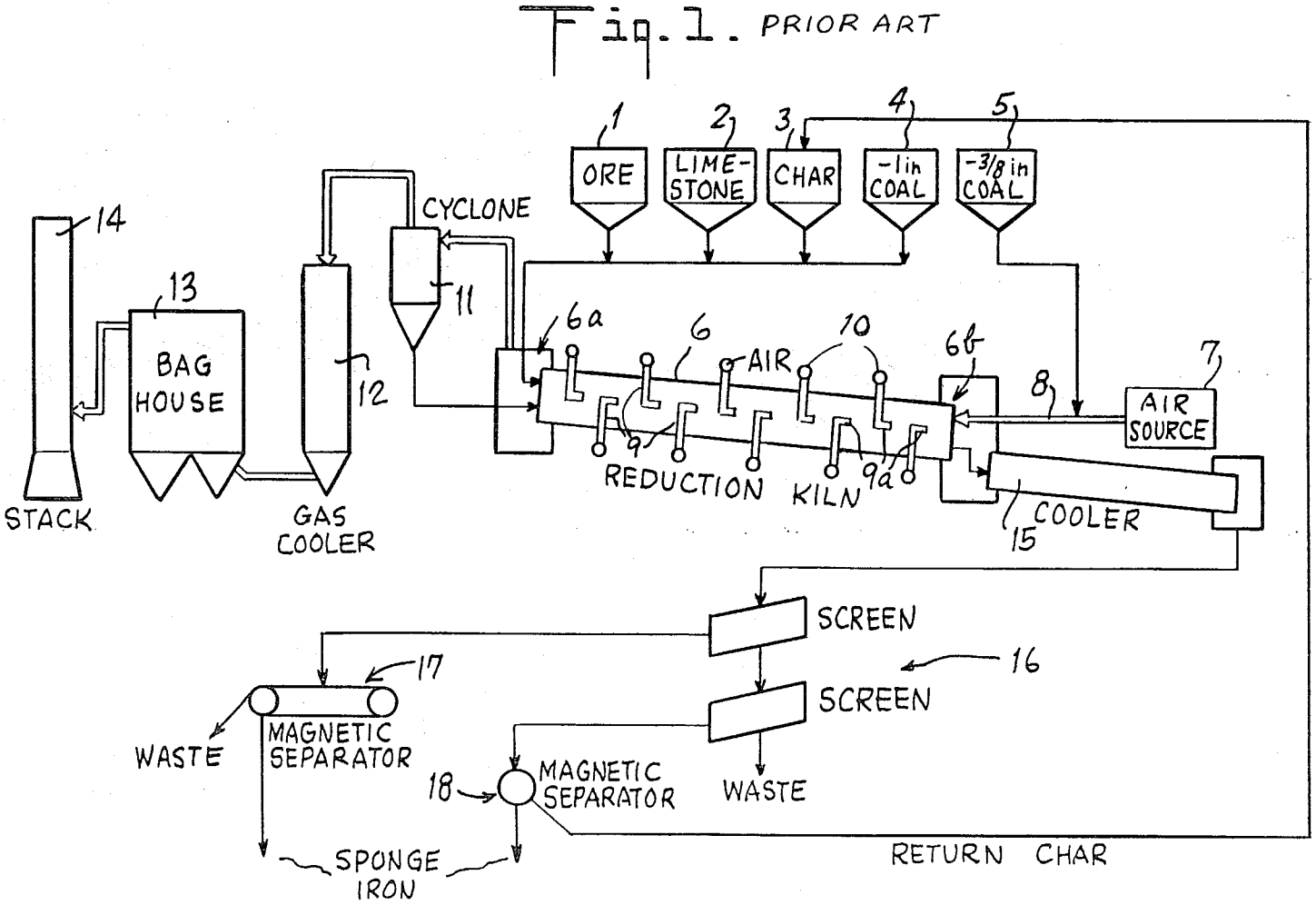
Fig. 1. PRIOR ART
FIG. 1 is a diagrammatic view of a prior art direct reduction plant for the production of sponge iron, which plant is of the type on which the present invention improves.

A direct reduction plant for the production of sponge iron of the type utilizing a rotary kiln operated in accordance with the HOCKIN process is shown in FIG. 1. The plant comprises an array of feed bins respectively including: a bin 1 for supplying ore in the form of iron oxide pellets; a bin 2 for providing limestone or dolomite; a bin 3 for supplying recycled char; and a bin 4 for providing a carbonaceous reducing agent in the form of coal of less than 1 inch nominal diameter particles. The iron ore pellets, coal, return char and dolomite or limestone are accurately proportioned and fed continuously as a charge to the feed end 6*a* of the reduction kiln 6. A remaining bin 5 supplies coal of less than ⅜ inch nominal diameter particles to the feed end 6*b* of the rotary kiln 6, where carefully controlled quantities are blown in together with carrier air from a suitable source 7 through a coal injection pipe 8 which can be adjusted to achieve the optimum trajectory for this coal.

The reduction kiln 6 may be typically 11.5 feet (3.5 meters) in outside shell diameter and 148 feet (45 meters) long, sloped at 3%. It may be supported on two tires and driven by a 200 horsepower variable speed D.C. motor and lined with 8 inches of castable refractory.

In addition to the introduction of carrier air through pipe 8, the kiln shell is equipped with a series of air injection tubes 9 which are spaced along its length and extend into the interior of the kiln for drawing air from the outside and injecting it along the kiln axis. Each of the tubes 9 is equipped with its own fan and motor combination 10 so that the rate of injection may be properly regulated along the kiln. In existing plants of this type the air injecting ends 9*a* of the tubes 9 are all directed toward the discharge end 6*b* of the reduction kiln to produce air flow in that direction for better mixing of the air with the countercurrent combustion and exhaust gases.

The hot waste or off-gases exhaust from the feed end 6*b* of the kiln and pass into an off-gas processing or cleaning system. In a suitable cleaning system the gases are passed first to twin refractory-lined scalping cyclones 11 and then to a 57 feet high by 11.5 feet inside diameter spray cooling tower 12 where they are cooled to 500° F. before passing to an 8-cell bag house 13 equipped with glass fiber bags. The cleaned gases exit via an induced draft fan and a 100 feet high stack 14.

The material discharged from the discharge end 6*b* of reduction kiln 6 consists of a mixture of sponge iron, coal char, coal ash and desulfurizing agent. This material is cooled in a rotary cooler 15 fitted with lifters and cooled externally with water. The cooled mixture is then passed from the cooler 15 to a screening system 16 and screened. The two oversized fractions are subject to magnetic separation in respective magnetic separators 17 and 18. Separator 17 removes the sponge iron from waste material and delivers the sponge iron to the product loadout area. The nonmagnetic fraction is conveyed to the return char bin 3.

While a plant such as shown and described in connection with FIG. 1 has, with proper control of combustion conditions over the kiln bed and reduction conditions in the bed, yielded high rates of heat transfer and optimum utilization of kiln volume with metallization of iron consistently in a 90%–95% range, still when high volatile coal is used at the feed and discharge ends, problems may arise with regard to the condition of the off-gases.

As the high-volatile coal introduced at the feed end is heated in the preheating zone of the kiln from ambient to the temperature of operation in the reduction zone, volatile hydrocarbons are distilled as gaseous mixtures from the coal. These hydrocarbon gases are carried by the process combustion gases out of the feed end of the kiln and into the gas handling and cleaning equipment. In this equipment their concentration by volume may be sufficient to form combustible mixtures if air be accidentally admitted therein creating an explosion risk. In the absence of air they may condense inside the dust cleaning equipment, e.g., on the baghouse bags, causing impaired performance thereof, and/or they may condense to a relatively stable aerosol suspended in the ambient air adjacent to and mixed with the total gas flow from the stack exit causing the opacity of the stack gas plume to exceed the opacity permitted by environmental regulations. In some prior art direct reduction systems it has become necessary to install afterburning equipment in the off-gas system to deal with problems of this type. However, it has been discovered that these problems can be solved without the need for afterburning equipment by modifying the direction of air injection in accordance with the present invention.

Figure 2:
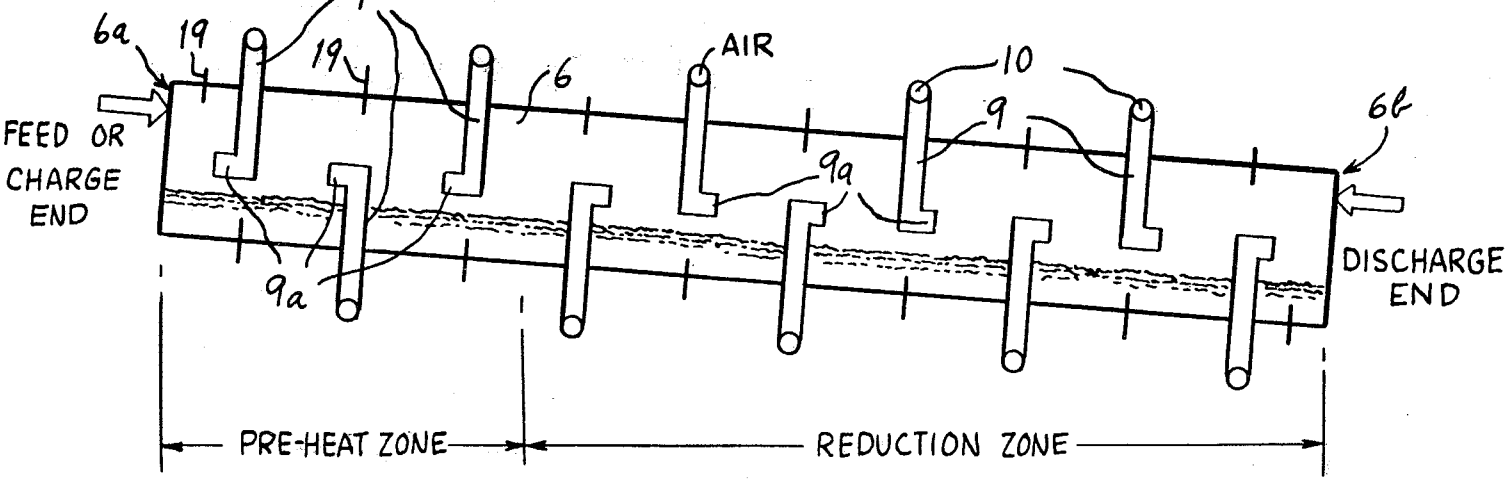
FIG. 2 is a diagrammatic view of a reduction kiln of the type used in the plant of FIG. 1, but which incorporates the present invention.

More particularly, the improved modification of the kiln 6 to conform to the present invention is shown in greater detail in FIG. 2. The rotary kiln 6 fitted with air injection devices 9, ten in number, is operated in accordance with the HOCKIN process, that is, using a high volatile, non-caking coal as the reductant and fuel and characterized in that part of the coal is added from the discharge end 6*b* of the kiln in such manner that substantially no coal is incorporated in the kiln bed within at least the last 15%, and preferably the last 20%, of the kiln length and so that some of the coal added from the discharge end of the kiln is distributed to within the feed-end region or zone of the kiln, and in that the remainder of the coal is added at the feed end 6a of the kiln. The amount of coal fed into the kiln from the discharge end 6b to maintain a satisfactory and controllable temperature profile is preferably within the range of 15%–30% by weight of the total coal feed. The rate of feed and the particle size of the coal are suitably controlled to make sure that the desired operating conditions are obtained. As indicated in FIG. 2, operationally the kiln is divided into two zones, that is, a preheat zone toward the feed end of the kiln, which extends for approximately the first one-third, but perhaps as far as the first one-half, of the kiln length, and a working or reduction zone which extends through the remainder of the kiln to the discharge end. In the preheat zone the ore, limestone or dolomite, coal, and recycled char are preheated gradually to the reduction temperature of approximately 1800° to 1950° F. The volatiles from the coal and the carbon monoxide formed by reduction in the kiln bed are combusted progressively by air admitted to the kiln through the spaced air tubes 9 mounted in the wall of the kiln. The temperature profile within the kiln is dependent on a number of factors and will differ with the type of coal used, its fixed carbon content, the volatile matter and its charring temperature and its ash softening temperature. The kiln temperatures are measured with twelve thermocouples 19 along the kiln 6 which are designed to separately measure the temperature of the charge in the kiln and the gas temperature.

With the exit nozzles 9a of the air injection tubes 9 all directed to introduce air flow countercurrent to the reducing gas flow in the kiln, that is, directed toward the discharge end 6b of the kiln as in FIG. 1, the composition of the off-gas from the feed end of the kiln may be such as to cause problems in the off-gas cleaning system as indicated above. It has been discovered, however, that by reversing the orientation of the nozzles 9a of one or more of the air injection tubes in the preheat zone of the kiln, preferably the three tubes 9', as shown in FIG. 2, the off-gas composition can be sufficiently improved to obviate any modifications to the off-gas cleaning system, such as the use of an afterburner, while the optimum temperature profile within the kiln can be maintained.

More particularly, it should be appreciated that with the exit nozzles 9a of the three air injection tubes 9' all directed in accordance with the prior practice to introduce air flow countercurrent to the combustion gas flow in the kiln, i.e., directed toward the discharge end 6b of the kiln as in FIG. 1, the air volume flow in the three tubes is required to be limited to the range from ten to thirty percent of the total air volume flow through all ten tubes of the kiln. This is necessary to prevent excessive heating of the kiln internal surfaces, by the otherwise complete oxidation and combustion of the volatile hydrocarbon gases to carbon dioxide and water vapor, which would cause sticking of the charge particles to each other and to the kiln internal surfaces, and to prevent overheating and consequent damage to the metal equipment feeding the charge materials into the kiln. It also prevents loss of control of the optimum temperature profile of the charge axially along the kiln in the preheating zone and the first one-third of the reduction zone.

However, with the exit nozzles 9a of the three air injection tubes 9' all directed to introduce air flow concurrent to the combustion gas flow in the kiln, i.e., directed toward the feed end 6a of the kiln in accordance with the present invention as shown in FIG. 2, the air volume flow in the three tubes 9' may advantageously be increased to the range from 65% to 85% of the total air volume flow through all ten air tubes of the kiln, thereby partially or substantially oxidizing and combusting the volatile hydrocarbon gases to carbon dioxide and water vapor in such a manner that the temperature of the total gas and air stream at their exit (6a) from the kiln does not cause excessive heating of the kiln internal surfaces in the preheating zone. In addition, it does permit maintaining the optimum temperature profile of the charge axially along the kiln in the preheating zone and the first one-third of the reduction zone. Substantially complete oxidation and combustion of the volatile hydrocarbon gases by the air from the three tubes 9' is effected within the preheating zone of the kiln and/or outside the feed end 6a of the kiln so that the aforementioned hydrocarbon gases do not cause the problems and difficulties in the gas cleaning system described above.

It will therefore be seen that by reversing the direction of injection of the air from one or more of the air supply tubes in the preheat zone of a kiln operating in accordance with the described process, the condition of the off-gases can be considerably improved without affecting the process in the reduction zone and ultimately the quality of the resulting product.

What is claimed is:

1. A method for introducing an oxygen-containing gas into a rotary kiln for the direct reduction of materials containing iron oxides using a solid carbonaceous reducing agent as the source of reductant and fuel, the kiln having a preheat zone toward the charge feed end through which some of the reducing agent is added and a reduction zone toward the discharge end through which the remainder of the reducing agent is added and wherein the combustion gases within the kiln flow toward and exhaust through the charge feed end, comprising the steps of injecting the oxygen-containing gas under pressure axially along the length of the kiln and directing said gas injected into at least the first part of the preheat zone toward the charge feed end concurrent with the combustion gases while directing the remainder of said gas injected into the kiln in the direction of the discharge end countercurrent to the combustion gases.

2. A method as in claim 1 wherein the volume flow of said oxygen-containing gas directed toward the feed end is in the range from 65% to 85% of the total volume of said gas injected into the kiln.

3. A method as in claim 1 wherein the oxygen-containing gas injected toward the feed end is injected along about the first third of the kiln length at the feed end.

4. A method as in claim 1 wherein said oxygen-containing gas is injected at ten positions along the length of the kiln and at least the gas injected at the position nearest the charge feed end is directed toward the feed end.

5. In the process for reducing materials containing iron oxides using a solid carbonaceous reducing agent and an oxygen-containing gas in a rotary kiln fitted with gas injection devices along its length and having a preheat zone toward the charge feed end and a reduction zone toward the discharge end and wherein part of the reducing agent is added through the discharge end of the kiln and the remainder is added with the charge at the feed end of the kiln, and wherein the oxygen-containing gas from the injection devices is injected under pressure in the direction toward the discharge end of the kiln countercurrent to the combustion gases flowing toward the exhausting through the charge feed end, the improvement comprising reversing the direction of injection of the oxygen-containing gas in at least a part of the preheat zone to direct it toward the feed end concurrent with the combustion gases.

6. A process as in claim 5 wherein the volume flow of the gas redirected toward the feed end is in the range from 65% to 85% of the total volume of oxygen-containing gas injected into the kiln.

7. A process as in claim 5 wherein about one-third of the gas injection devices are redirected to produce oxygen-containing gas flow in the direction of the kiln feed end.

8. A method as in claim 1 or 9 wherein said solid carbonaceous reducing agent comprises coal and said oxygen-containing gas comprises air.

9. A method as in claim 6 wherein substantially no reducing agent added through the discharge end is incorporated in the charge bed within at least the last 15% of the kiln length and some of this agent is distributed to within the feed end region of the kiln.

* * * * *

UNITED STATES PATENT AND TRADEMARK OFFICE

CERTIFICATE OF CORRECTION

PATENT NO. : 4,330,325

DATED : May 18, 1982

INVENTOR(S) : Vitie P. Keran; Alan C. Baker

It is certified that error appears in the above-identified patent and that said Letters Patent are hereby corrected as shown below:

Claim 3, at Col. 6, Line 52:

"wherein the" should read --wherein said--.

Claim 8, at Col. 8, Line 5:

"1 or 9" should read --1 or 6--.

Signed and Sealed this

*Third* Day of *August 1982*

[SEAL]

*Attest:*

GERALD J. MOSSINGHOFF

*Attesting Officer*

*Commissioner of Patents and Trademarks*